US009786211B2

(12) United States Patent
Guo et al.

(10) Patent No.: US 9,786,211 B2
(45) Date of Patent: Oct. 10, 2017

(54) DISPLAY PANEL, DRIVING METHOD AND DISPLAY APPARATUS

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Lei Guo, Beijing (CN); Shuai Xu, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 15/122,632

(22) PCT Filed: Sep. 15, 2015

(86) PCT No.: PCT/CN2015/089605

§ 371 (c)(1),
(2) Date: Aug. 30, 2016

(87) PCT Pub. No.: WO2016/169194

PCT Pub. Date: Oct. 27, 2016

(65) Prior Publication Data

US 2017/0069243 A1 Mar. 9, 2017

(30) Foreign Application Priority Data

Apr. 24, 2015 (CN) ..... 2015 1 0202920

(51) Int. Cl.
*G09G 3/20* (2006.01)

(52) U.S. Cl.
CPC ..... *G09G 3/2003* (2013.01); *G09G 3/2085* (2013.01); *G09G 3/2092* (2013.01);
(Continued)

(58) Field of Classification Search
CPC combination set(s) only.
See application file for complete search history.

(56) References Cited

U.S. PATENT DOCUMENTS 8,274,503 B2 9/2012 Kwon
2008/0136806 A1 6/2008 Lee et al.
(Continued)

FOREIGN PATENT DOCUMENTS

CN 101231404 A 7/2008
CN 104200784 A 12/2014
(Continued)

OTHER PUBLICATIONS

Office Action in Chinese Application No. 201510202920.6 dated Nov. 4, 2016, with English translation. 6 pages.
(Continued)

*Primary Examiner* — Van Chow
(74) *Attorney, Agent, or Firm* — Blakely Sokoloff Taylor & Zafman LLP

(57) ABSTRACT

The present disclosure provides a display panel, a driving method and a display apparatus. The data signals are outputted by different operational amplifiers to the subpixels of different colors connected to the same data line, and the data signals are outputted by the same operational amplifier to the subpixels of the same color on the same data line.

20 Claims, 8 Drawing Sheets

(52) U.S. Cl.
CPC ..... *G09G 2300/0452* (2013.01); *G09G 2310/0291* (2013.01); *G09G 2310/0297* (2013.01); *G09G 2320/0233* (2013.01); *G09G 2320/0626* (2013.01)

(56) References Cited

U.S. PATENT DOCUMENTS

| | | | |
|---|---|---|---|
| 2008/0180462 | A1 | 7/2008 | Nose |
| 2011/0169879 | A1 | 7/2011 | Hashimoto |

FOREIGN PATENT DOCUMENTS

| | | | |
|---|---|---|---|
| CN | 104464607 | A | 3/2015 |
| CN | 104766564 | A | 7/2015 |
| GB | 2325329 | A | 11/1998 |

OTHER PUBLICATIONS

International Search Report and Written Opinion in PCT/CN2015/089605 dated Feb. 14, 2016, with English Translation. 14 pages.

DISPLAY PANEL, DRIVING METHOD AND DISPLAY APPARATUS

RELATED APPLICATIONS

The present application is the U.S. national phase entry of PCT/CN2015/089605, with an international filing date of Sep. 15, 2015, which claims the benefit of Chinese Patent Application No. 201510202920.6, filed on Apr. 24, 2015, the entire disclosures of which are incorporated herein by reference.

FIELD

The present disclosure relates to the field of display technology, and particularly to a display panel, a driving method and a display apparatus.

BACKGROUND

In conventional liquid crystal display apparatuses and organic light-emitting diode (OLED) display apparatuses, each point (pixel) displays color via a plurality of subpixels by means of light mixing. For example, each pixel consists of one red subpixel, one green subpixel and one blue subpixel (RGB mode).

In order to improve the visual effect, people have put forward higher and higher requirement on the resolution (the number of pixels in unit area) of the display apparatus. This requires the size of subpixel to be smaller and smaller. However, the size of subpixel cannot be reduced without limit due to process limitation.

To improve the display effect in the case that the subpixel size is fixed, people propose a virtual display design in a Rainbow arrangement manner. In this design, the arrangement manner of the RGB (Red, Green, Blue) subpixels is the RGB Rainbow arrangement manner. As shown in FIG. 1, the display panel comprises pixel groups 1 arranged in a matrix which consist of a plurality of subpixels. The respective pixel groups 1 comprise four row and three columns of subpixels, which are red subpixels R, green subpixels G and blue subpixels B; blue subpixels B, red subpixels R and green subpixels G; green subpixels G, blue subpixels B and red subpixels R; blue subpixels B, red subpixels R and green subpixels G, respectively; gate lines Gate connected to the subpixels of respective rows, data lines Data connected to the subpixels of respective columns, and operational amplifiers 2 connected to the respective data lines Data in one-to-one correspondence. As compared to the traditional display panel, the above display panel virtually designed can reduce the number of subpixels by a third while achieving the same display effect by means of such particular Rainbow subpixel arrangement manner and corresponding virtual algorithm.

However, since the above virtual display panel is different from the traditional display panel in that the same data line Data is connected with subpixels of three different colors (R, G, B), the operational amplifiers 2 need to output data signals to the subpixels of respective colors connected to the corresponding data line successively according to the scanning order. In this way, when displaying a picture of solid color (i.e. the grayscale values of R, G, B are all fixed values), the previous row of the green subpixels G may be red subpixels R and may also be blue subpixels B. When the grayscale values of R, G, B are all different, the grayscale values outputted by the same operational amplifier are jumping all the time. For example, when R=0, G=127, B=255 or R=255, G=127, B=0, the grayscale value 127 outputted by the operational amplifier to the green subpixels G may result from jumping from 0 of the previous row, and may also result from jumping from 255 of the previous row. Although at last the grayscale values of the green subpixels G in the entire display panel are all 127, jumping from 0 to 127 actually requires more electrical charges charging the green subpixels G than jumping from 255 to 127, such that the brightness of the green subpixels G with a grayscale value of 127 which jumps from 0 is higher than that of the green subpixels G with a grayscale value of 127 which jumps from 255, thereby visually presenting bright and dark horizontal stripes and influencing the display effect of the display panel.

SUMMARY

In view of the above, embodiments of the present disclosure provide a display panel, a driving method and a display apparatus for eliminating the bright and dark horizontal stripes presented on the display panel when displaying a picture of solid color, thereby improving the display effect of the display panel.

Therefore, a first aspect of the present disclosure provides a display panel which may comprise: several pixel groups arranged in a matrix which consist of N-row×M-column subpixels, gate lines connected to subpixels of respective rows, and data lines connected to subpixels of respective columns; wherein N is a positive integer larger than 2, M is a positive integer larger than 1, and in one and the same pixel group, subpixels of the same column comprise subpixels of at least two colors. The display panel further comprises a plurality of operational amplifiers corresponding to respective data lines, respective operational amplifiers being connected to corresponding data lines via corresponding switching devices, respectively, and a control unit connected to respective switching devices. The number of operational amplifiers corresponding to each data line is equal to that of color types of subpixels connected to the data line, and one operational amplifier corresponds to subpixels of one color. In a plurality of operational amplifiers corresponding to each data line, respective operational amplifiers are used to output data signals to subpixels of corresponding colors connected to the corresponding data line successively according to a scanning order of the gate lines.

The control unit is used to, for subpixels of the m-th column of the display panel, control one of the switching devices connected to the data line that is connected to the subpixels of the m-th column to be in conducting state when the gate line of the n-th row is scanned, and the switching device in conducting state is a switching device connected to the operational amplifier for outputting data signals to the subpixels of the n-th row.

In accordance with an embodiment, in the above display panel provided by embodiments of the present disclosure, when M is larger than 1, for M data lines corresponding to each column of pixel groups, the data lines connected with the subpixels of the same color may correspond to the same operational amplifier that outputs data signals to the subpixels of the same color.

In accordance with another embodiment, in the above display panel provided by embodiments of the present disclosure, in one and the same pixel group, the number of color types of the subpixels in each column of subpixels may be the same, and the color types may be the same.

In accordance with a further embodiment, in the above display panel provided by embodiments of the present disclosure, N=4, M=3, and in one and the same pixel group, subpixels of a first row may be a subpixel of a first color, a subpixel of a second color and a subpixel of a third color, respectively, subpixels of a second row may be a subpixel of the third color, a subpixel of the first color and a subpixel of the second color, respectively, subpixels of a third row may be a subpixel of the second color, a subpixel of the third color and a subpixel of the first color, respectively, and subpixels of a fourth row may be a subpixels of the third color, a subpixel of the first color and a subpixel of the second color, respectively.

In accordance with yet another embodiment, in the above display panel provided by embodiments of the present disclosure, the first color, the second color and the third color may be one of red, green and blue, respectively.

In accordance with additional embodiments, in the above display panel provided by embodiments of the present disclosure, the switching device may be a transmission gate. A positive phase control terminal and a negative phase control terminal of the transmission gate are both connected to the control unit, an input terminal of the transmission gate is connected to corresponding operational amplifiers, and an output terminal of the transmission gate is connected to corresponding data lines.

In accordance with additional embodiments, in the above display panel provided by embodiments of the present disclosure, the switching device may be a switching transistor. A gate of the switching transistor is connected to the control unit, a first end of the switching transistor is connected to corresponding operational amplifiers, a second end of the switching transistor is connected to corresponding data lines, and the first end and the second end are one of a source and a drain, respectively.

As known to those skilled in the art, the source of a transistor is not distinguished from the drain thereof. Therefore, the first end of the above transistor can indicate both the source and the drain, and the second end can also indicate both the drain and the source, as long as the first end is different from the second end.

In accordance with some embodiments, in the above display panel provided by embodiments of the present disclosure, the switching transistor may be an N-type transistor or P-type transistor.

Accordingly, a second aspect of the present disclosure further provides a method for driving any display panel stated above. The method may comprise:

scanning gate lines of respective rows successively within one frame of picture;

for subpixels of the m-th column of the display panel, when the gate line of the n-th row is scanned, the control unit controlling one of the switching devices connected to the data line that is connected to the subpixels of the m-th column to be in conducting state, the operational amplifiers corresponding to the subpixels of the n-th row outputting data signals to the subpixels of the n-th row via the switching device in conducting state.

Accordingly, a third aspect of the present disclosure further provides a display apparatus comprising any display panel provided by embodiments of the present disclosure.

In the display panel, driving method and display apparatus provided by embodiments of the present disclosure, since the data signals are outputted by different operational amplifiers to the subpixels of different colors connected to the same data line, and the data signals are outputted by the same operational amplifier to the subpixels of the same color connected with the same data line, when the above display panel displays one frame of picture of solid color, even if the subpixels of different colors correspond to different grayscale values, since the subpixels of the same color connected to the same data line correspond to the same operational amplifier, that is, the data signals of the subpixels of the same color which have the same grayscale value are always outputted by the same operational amplifier, grayscale jump would not take place. Consequently, the charging amounts for the subpixels of the same color are identical and the brightnesses thereof are also the same upon display, thereby eliminating the bright and dark horizontal stripes presented on the display panel when displaying a picture of solid color and improving the display effect of the display panel.

DETAILED DESCRIPTION

Specific implementations of the display panel, driving method and display apparatus provided by embodiments of the present disclosure are set forth below in detail with reference to the drawings.

Figure 1:
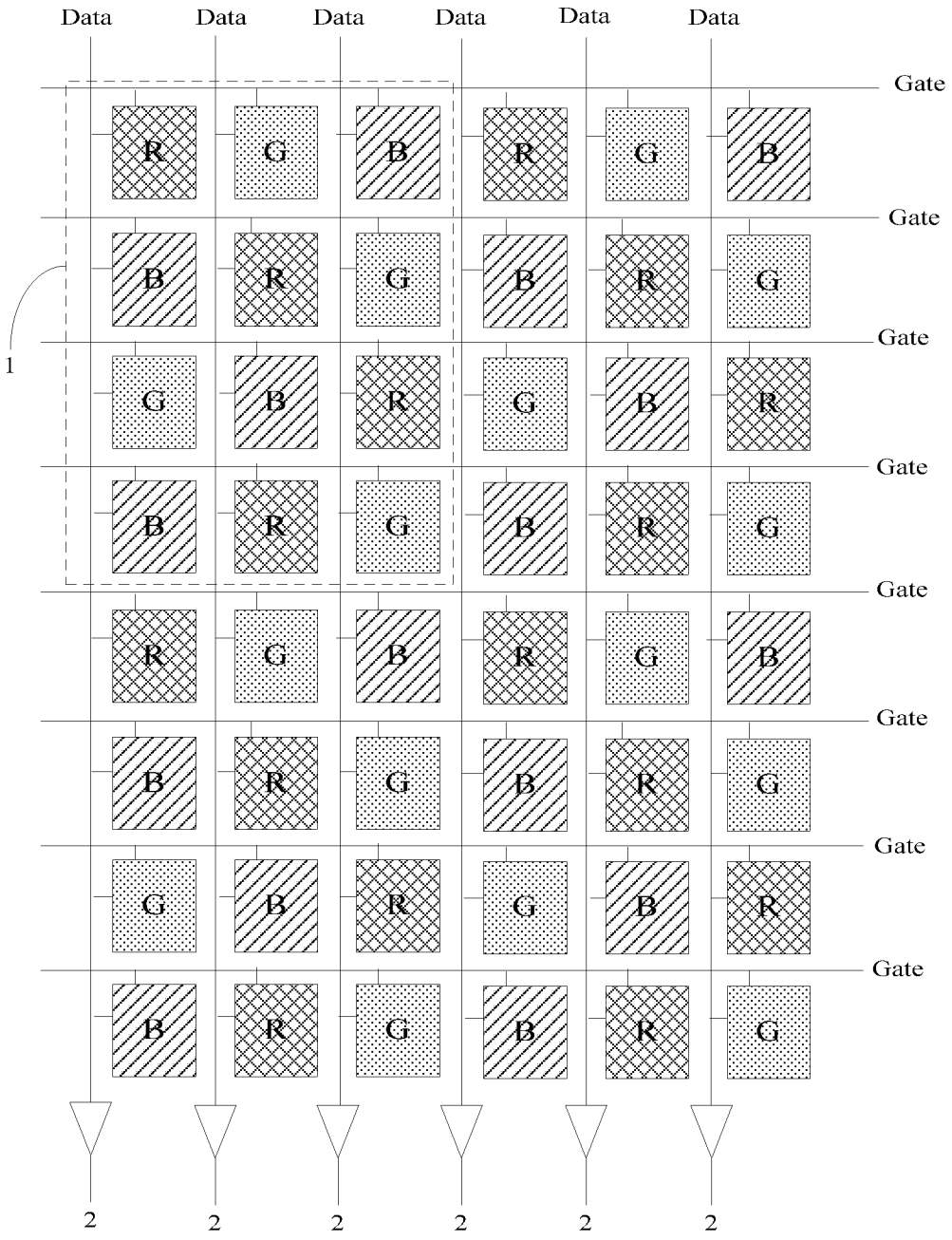
FIG. 1 is a structural diagram of an existing display panel in Rainbow arrangement manner.
Figure 2:
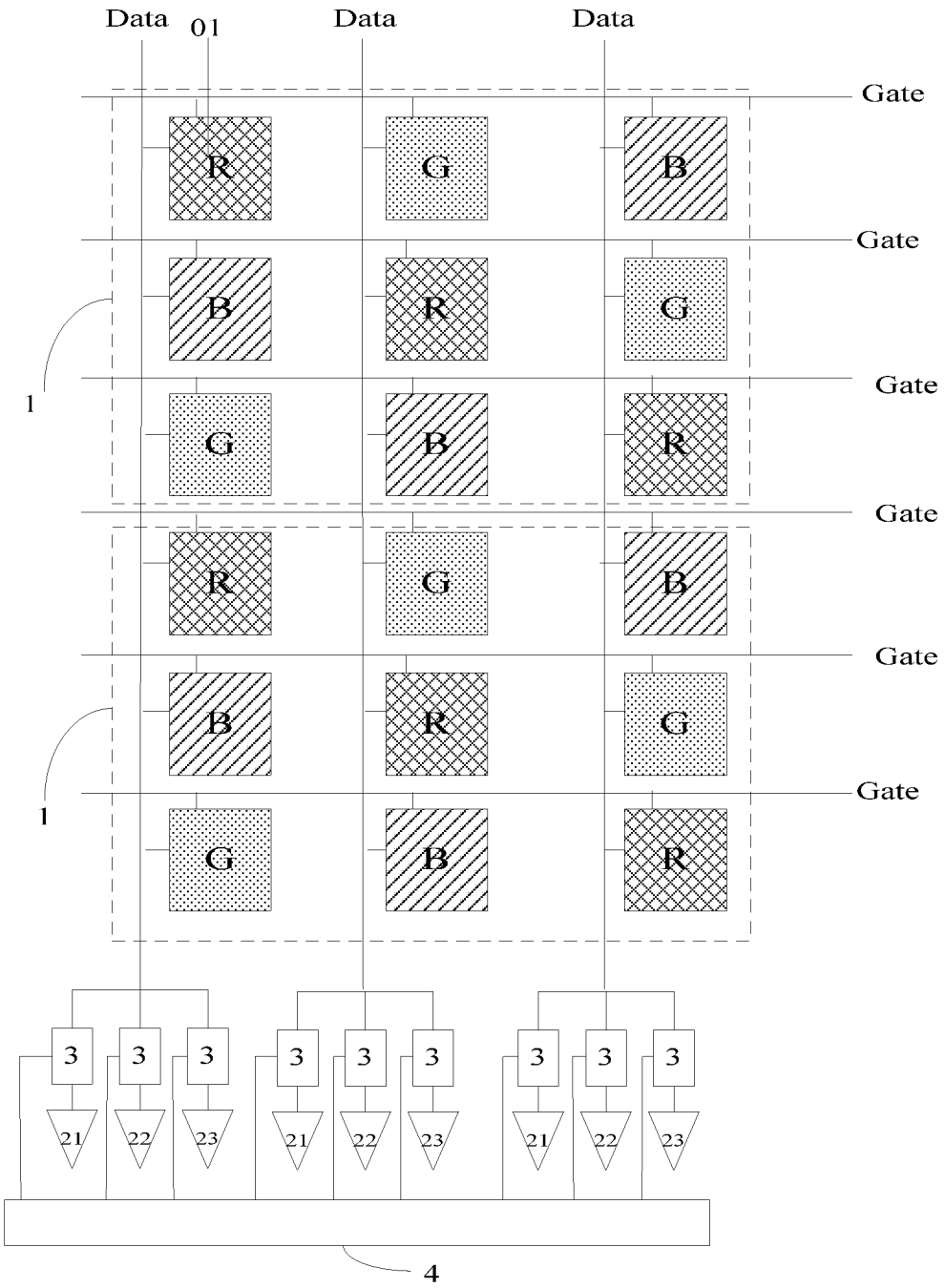
FIG. 2 is a structural diagram of a display panel provided by an embodiment of the present disclosure.

A display panel provided by embodiments of the present disclosure comprises, as shown in FIG. 2, several pixel groups 1 arranged in a matrix which consist of N-row×M-column subpixels 01, gate lines Gate connected to subpixels 01 of respective rows, and data lines Data connected to subpixels 01 of respective columns; wherein N is a positive integer greater than 2, M is a positive integer greater than 1, and in one and the same pixel group 1, the subpixels 01 of the same column comprise subpixels 01 of at least two colors. FIG. 2 makes illustration taking the example that N=3, M=3, and the subpixels 01 of the same column comprise subpixels 01 of three colors which are red subpixels R, green subpixels G and blue subpixels B, respectively.

The display panel further comprises a plurality of operational amplifiers (21, 22 and 23 in FIG. 2) corresponding to respective data lines Data, respective operational amplifiers being connected to corresponding data lines Data via corresponding switching devices 3, and a control unit 4 connected to respective switching devices 3.

The number of the operational amplifiers corresponding to each data line Data is equal to the number of color types of the subpixels 01 connected to the data line Data, and one operational amplifier (21, 22 or 23) corresponds to subpixels 01 of one color (e.g. in FIG. 2 21 corresponds to red subpixels R, 22 corresponds to green subpixels G, and 23 corresponds to blue subpixels B). In the plurality of operational amplifiers corresponding to each data line Data, the respective operational amplifiers are used to output data signals to the subpixels 01 of corresponding colors which are connected to the corresponding data line Data successively according to the scanning order of the gate lines Gate.

The control unit 4 is used to, for the subpixels 01 of the m-th column of the display panel, control one of the switching devices 3 connected to the data line Data that is connected to the subpixels 01 of the m-th column to be in conducting state when the gate line Gate of the n-th row is scanned, and the switching device 3 in conducting state is a switching device 3 connected to the operational amplifiers for outputting data signals to the subpixels 01 of the n-th row.

In the above display panel provided by embodiments of the present disclosure, since the data signals are outputted by different operational amplifiers to the subpixels of different colors connected to the same data line, and the data signals are outputted by the same operational amplifier to the subpixels of the same color connected with the same data line, when the above display panel displays one frame of picture of solid color, even if the subpixels of different colors correspond to different grayscale values, since the subpixels of the same color connected to the same data line correspond to the same operational amplifier, that is, the data signals of the subpixels of the same color which have the same grayscale value are always outputted by the same operational amplifier, grayscale jump would not take place. Consequently, the charging amounts for the subpixels of the same color are identical and the brightnesses thereof are also the same upon display, thereby eliminating the bright and dark horizontal stripes presented on the display panel when displaying a picture of solid color and improving the display effect of the display panel.

Figure 3:
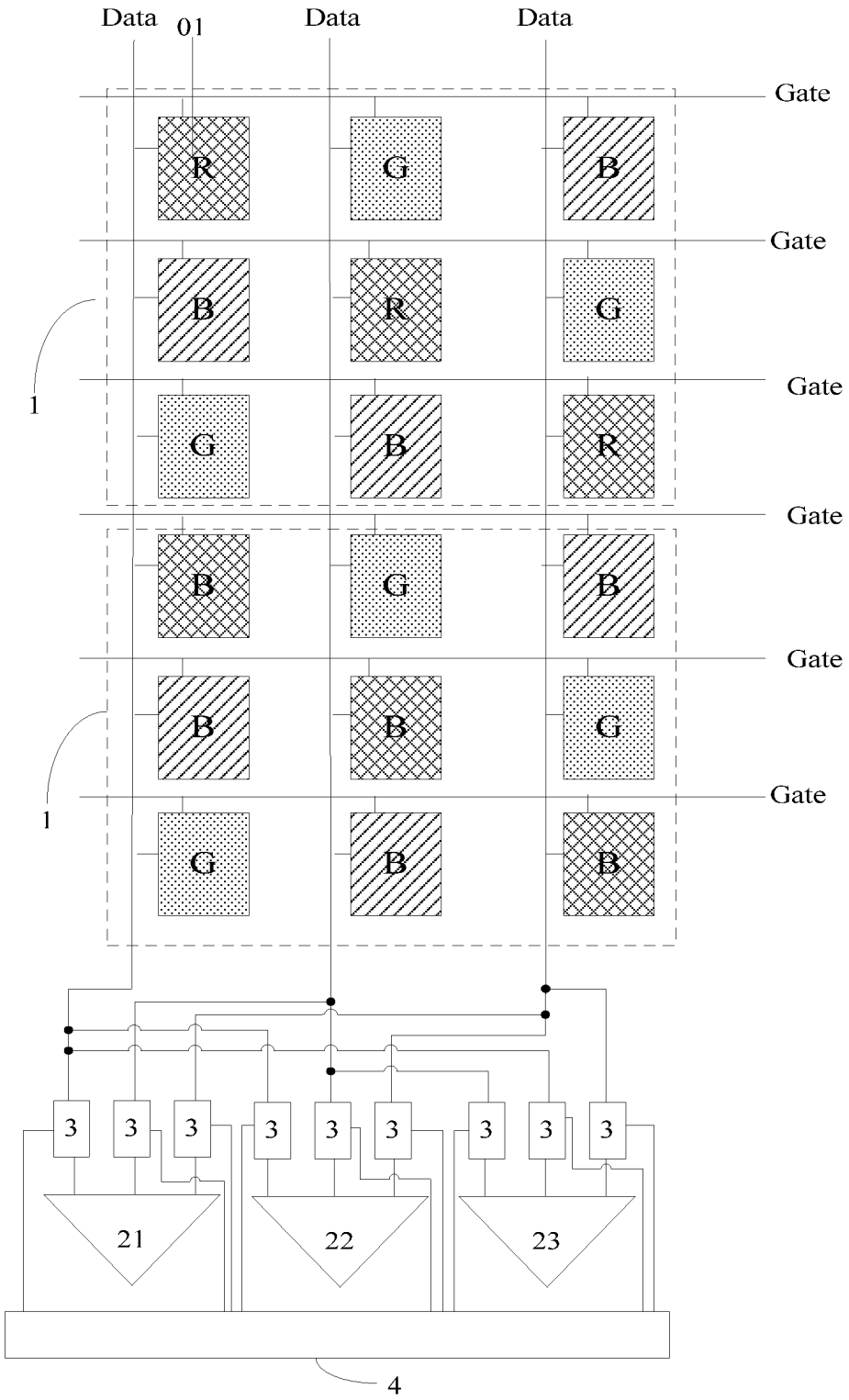
FIG. 3 is a structural diagram of a display panel provided by another embodiment of the present disclosure.

Further, in the above display panel provided by embodiments of the present disclosure, as shown in FIG. 3, when M is larger than 1, for M data lines Data corresponding to each column of pixel groups 1, the data lines Data connected with the subpixels 01 of the same color correspond to the same operational amplifier which outputs data signals to the subpixels 01 of the same color. As shown in FIG. 3, assume that one column of pixel groups 1 has three columns of subpixels, then it corresponds to three data lines Data, and subpixels 01 of the first column, subpixels 01 of the second column and subpixels 01 of the third column all comprise red subpixels R, green subpixels G and blue subpixels B. Therefore, the three data lines Data are all connected to the same operational amplifier (21 in FIG. 3) corresponding to the red subpixels R, the same operational amplifier (22 in FIG. 3) corresponding to the green subpixels G, and the same operational amplifier (23 in FIG. 3) corresponding to the blue subpixels B. Namely, the three data lines corresponding to one column of pixel groups are connected to three operational amplifiers (21, 22 and 23 in FIG. 3), respectively. In this way, the number of amplifiers can be reduced by sharing the amplifiers, thereby reducing the cost.

Further, in the above display panel provided by embodiments of the present disclosure, in one and the same pixel group, the numbers of color types of the subpixels in respective columns of subpixels are the same, and the color types are the same. For example, each column of subpixels comprises subpixels of three colors, and the types of the three colors in each column of subpixels are the same. In this way, in one and the same pixel group, each data line is connected to the same number of operational amplifiers, and each operational amplifier is connected to each data line corresponding to one and the same pixel group.

Figure 4A:
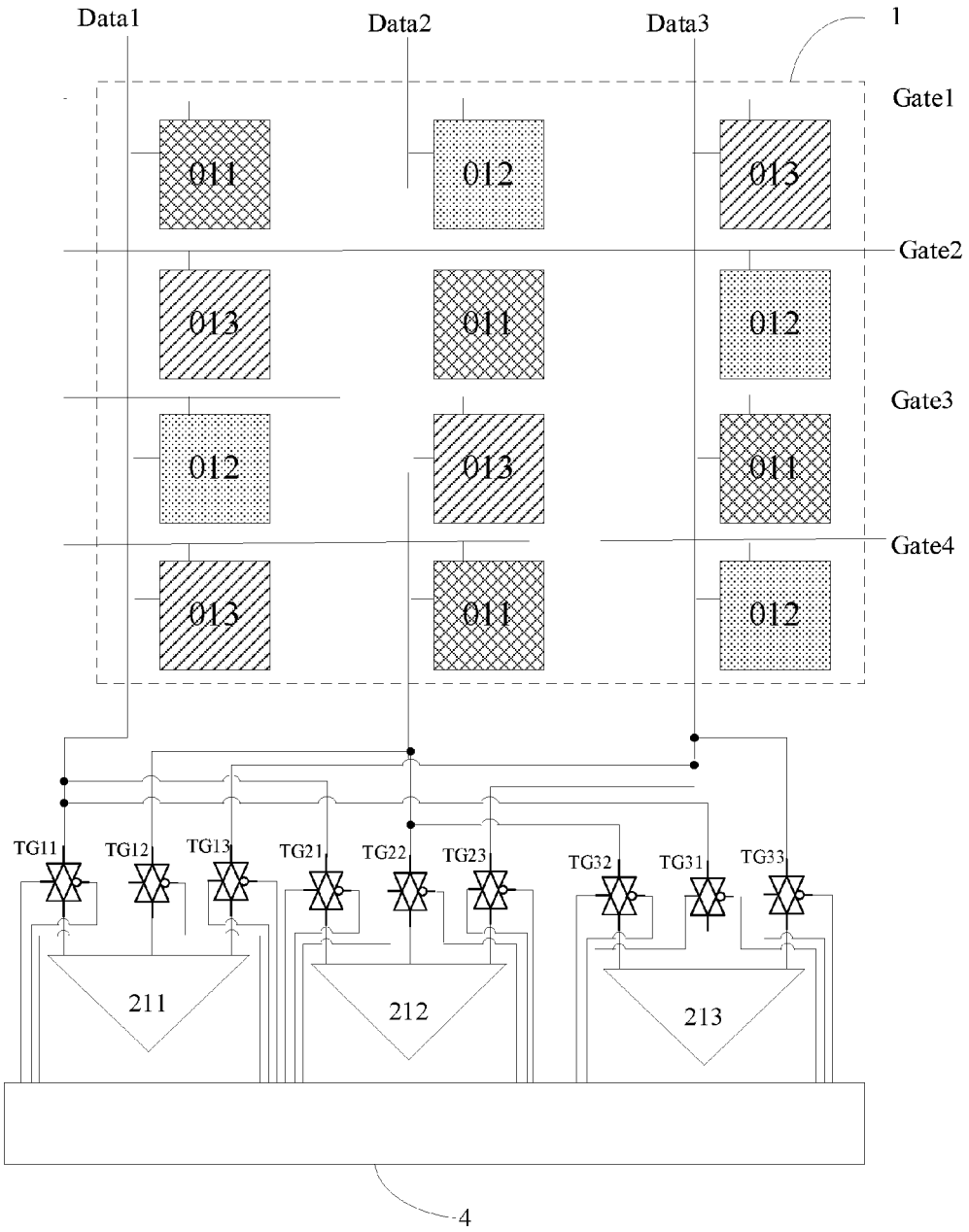
FIGS. 4*a*-4*c* are a specific structural diagram of a display panel provided by embodiments of the present disclosure, respectively.
Figure 4B:
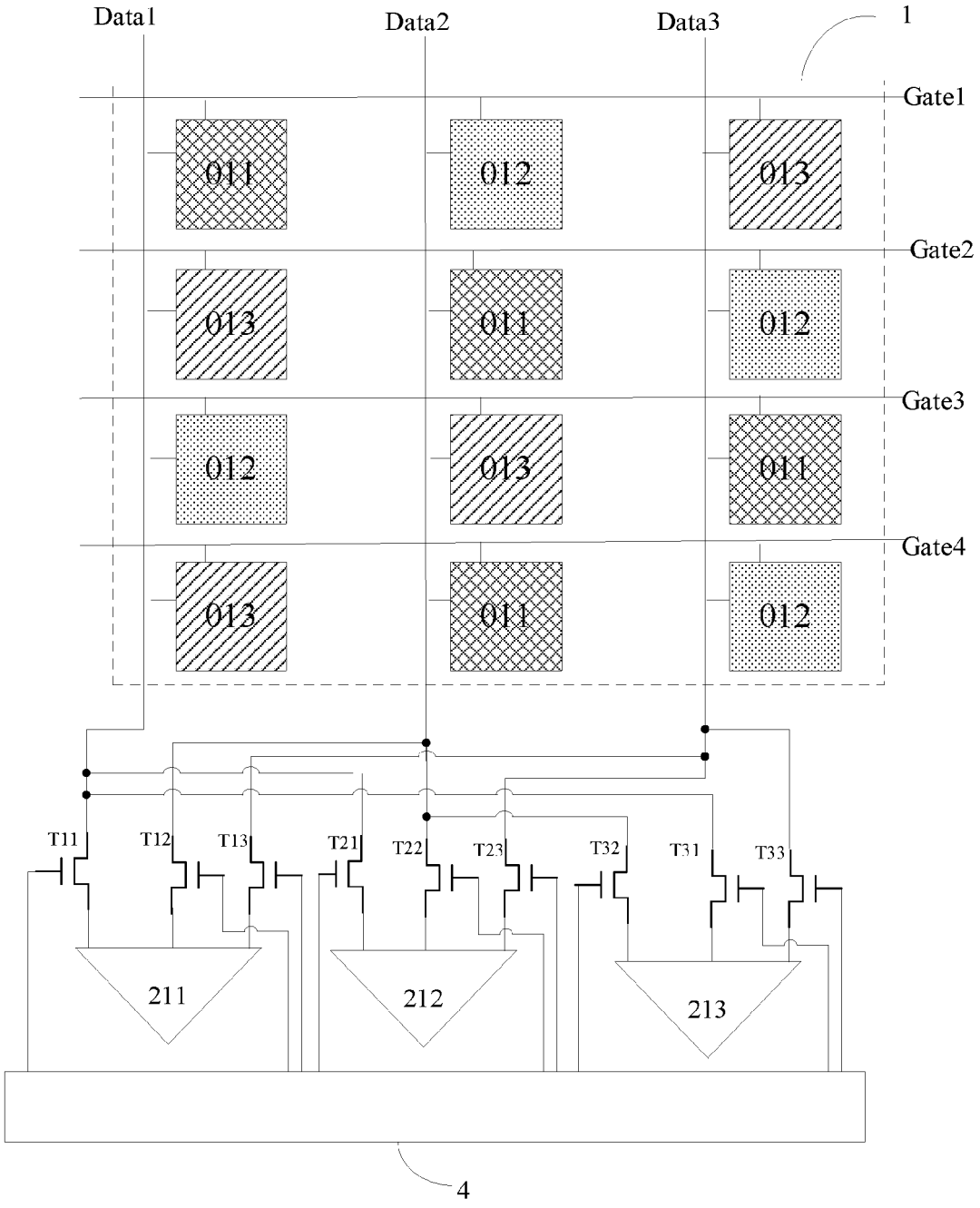
Figure 4C:
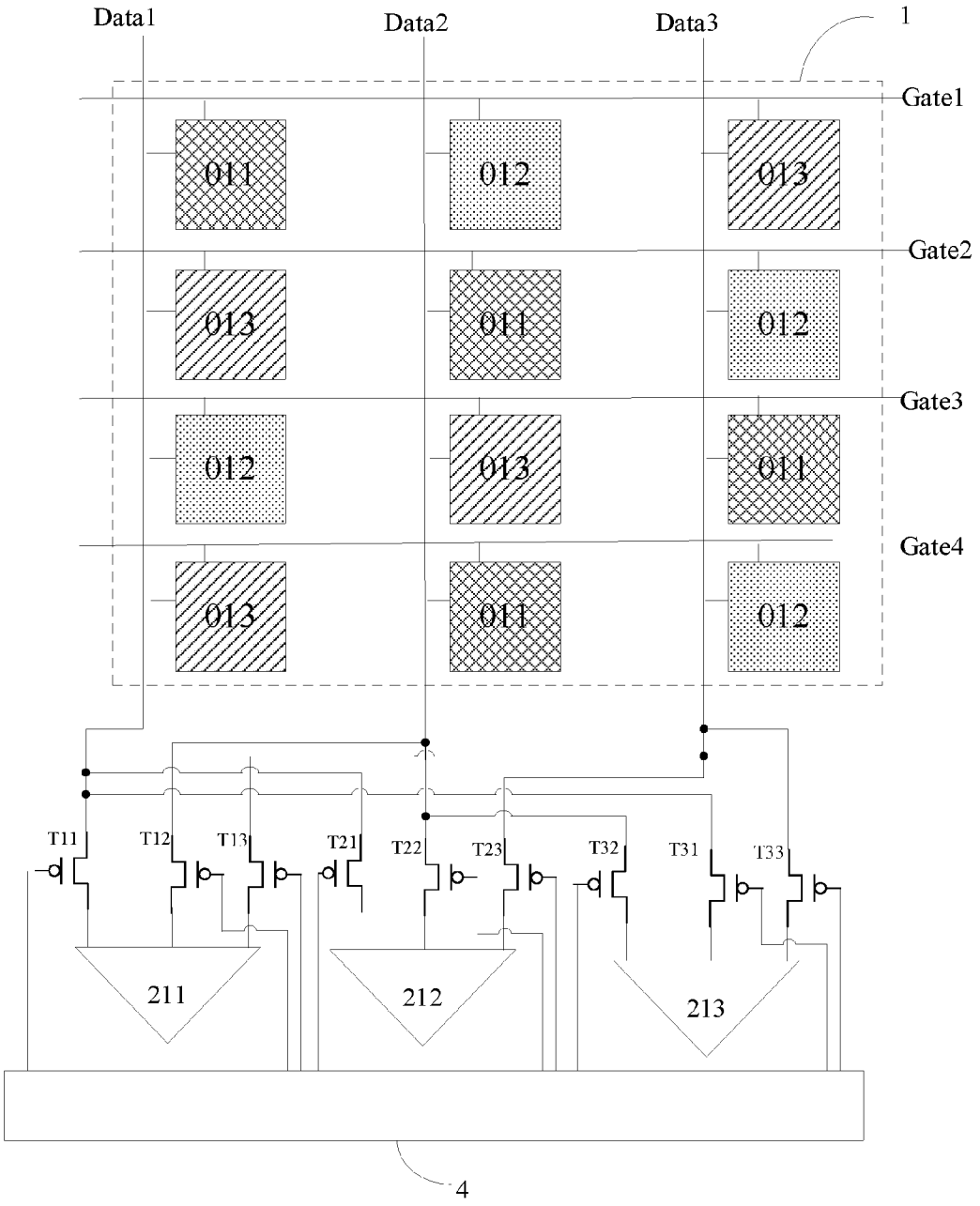

Specifically, upon specific implementation, the above display panel provided by embodiments is particular suitable for a display panel in Rainbow arrangement manner. As shown in FIGS. 4*a* to 4*c*, in one pixel group, N=4, M=3, and in one and the same pixel group, the subpixels 01 of the first row are a subpixel 011 of a first color, a subpixel 012 of a second color and a subpixel 013 of a third color, respectively; the subpixels 01 of the second row are a subpixel 013 of the third color, a subpixel 011 of the first color and a subpixel 012 of the second color, respectively; the subpixels of the third row are a subpixel 012 of the second color, a subpixel 013 of the third color and a subpixel 011 of the first color, respectively; the subpixels of the fourth row are a subpixel 013 of the third color, a subpixel 011 of the first color and a subpixel 012 of the second color, respectively.

Upon specific implementation, in the above display panel provided by embodiments of the present disclosure, the first color, the second color and the third color are one of red, green and blue, respectively. Assuming that the first color is red, the second color can only be green or blue, and the third color can only be blue or green.

Specifically, in FIGS. 4*a* to 4*c*, one pixel group is taken as an example, wherein the data lines connected to respective columns of subpixels in one-to-one correspondence are Data 1, Data 2 and Data 3, respectively, the gate lines connected to respective rows of subpixels in one-to-one correspondence are Gate 1, Gate 2, Gate 3 and Gate 4, respectively, the operational amplifier for providing a data signal to the subpixel 011 of the first color is 211, the operational amplifier for providing a data signal to the subpixel 012 of the second color is 212, and the operational amplifier for providing a data signal to the subpixel 013 of the third color is 213.

In accordance with some embodiments of the present disclosure, in the above display panel provided by embodiments of the present disclosure, the switching device may be a transmission gate, a switching transistor or other electronic switching devices, which are not defined here.

Since there would be signal loss during the transmission of signals from the source to the drain when the switching transistor is in conducting state, in order to avoid such signal loss, the switching device may be a transmission gate in the above display panel provided by embodiments of the present disclosure.

Specifically, upon specific implementation, in the above display panel provided by embodiments of the present disclosure, as shown in FIG. 4*a*, the switching device 3 is a transmission gate (in FIG. 4*a* the three transmission gates connected to the data line Data 1 are TG11, TG12 and TG13, respectively, the three transmission gates connected to the data line Data 2 are TG21, TG22 and TG23, respectively, and the three transmission gates connected to the data line Data 3 are TG31, TG32 and TG33, respectively).

The positive phase control terminal and the negative phase control terminal of the transmission gate are both connected to the control unit 4, the input terminal thereof is connected to a corresponding operational amplifier 2, and the output terminal thereof is connected to a corresponding data line Data. When the signal of the positive phase control terminal is a high level signal, and the signal of the negative phase control terminal is a low level signal, the transmission gate is in conducting state; when the signal of the positive phase control terminal is a low level signal, and the signal of the negative phase control terminal is a high level signal, the transmission gate TG is in cut-off state.

Specifically, upon specific implementation, in the above display panel provided by embodiments of the present disclosure, as shown in FIGS. 4*b* and 4*c*, the switching device 3 is a switching transistor (in FIGS. 4*b* and 4*c* the three switching transistors connected to the data line Data 1 are T11, T12 and T13, respectively, the three switching transistors connected to the data line Data 2 are T21, T22 and T23, respectively, and the three switching transistors connected to the data line Data 3 are T31, T32 and T33, respectively).

The gate of the switching transistor is connected to the control unit 4, the source thereof is connected to a corresponding operational amplifier 2, and the drain thereof is connected to a corresponding data line Data.

It is to be noted that the source of the switching transistor is not distinguished from the drain thereof. Therefore, in the above arrangement, it is also possible that the drain of the switching transistor is connected to a corresponding operational amplifier 2, and the source thereof is connected to a corresponding data line Data.

Further, in the above display panel provided by embodiments of the present disclosure, the switching transistor may be an N-type transistor or may also be a P-type transistor. As shown in FIG. 4*b*, when the switching transistor is an N-type transistor and the signal of the gate is a high level signal, the switching transistor is in conducting state; when the signal of the gate is a low level signal, the switching transistor is in cut-off state. Or, as shown in FIG. 4*c*, when the switching transistor is a P-type transistor and the signal of the gate is a low level signal, the switching transistor is in conducting state; when the signal of the gate is a high level signal, the switching transistor is in cut-off state.

Further, in the display panel provided by embodiments of the present disclosure, when the switching transistors are all N-type transistors or all P-type transistors, when the gate line of the n-th row is scanned, one of the plurality of switching transistors connected to each data line is in conducting state. Therefore, the control unit can send the same control signal to the gates of these switching transistors in conducting state to control these switching transistors to be in conducting state simultaneously or in cut-off state simultaneously.

Figure 5:
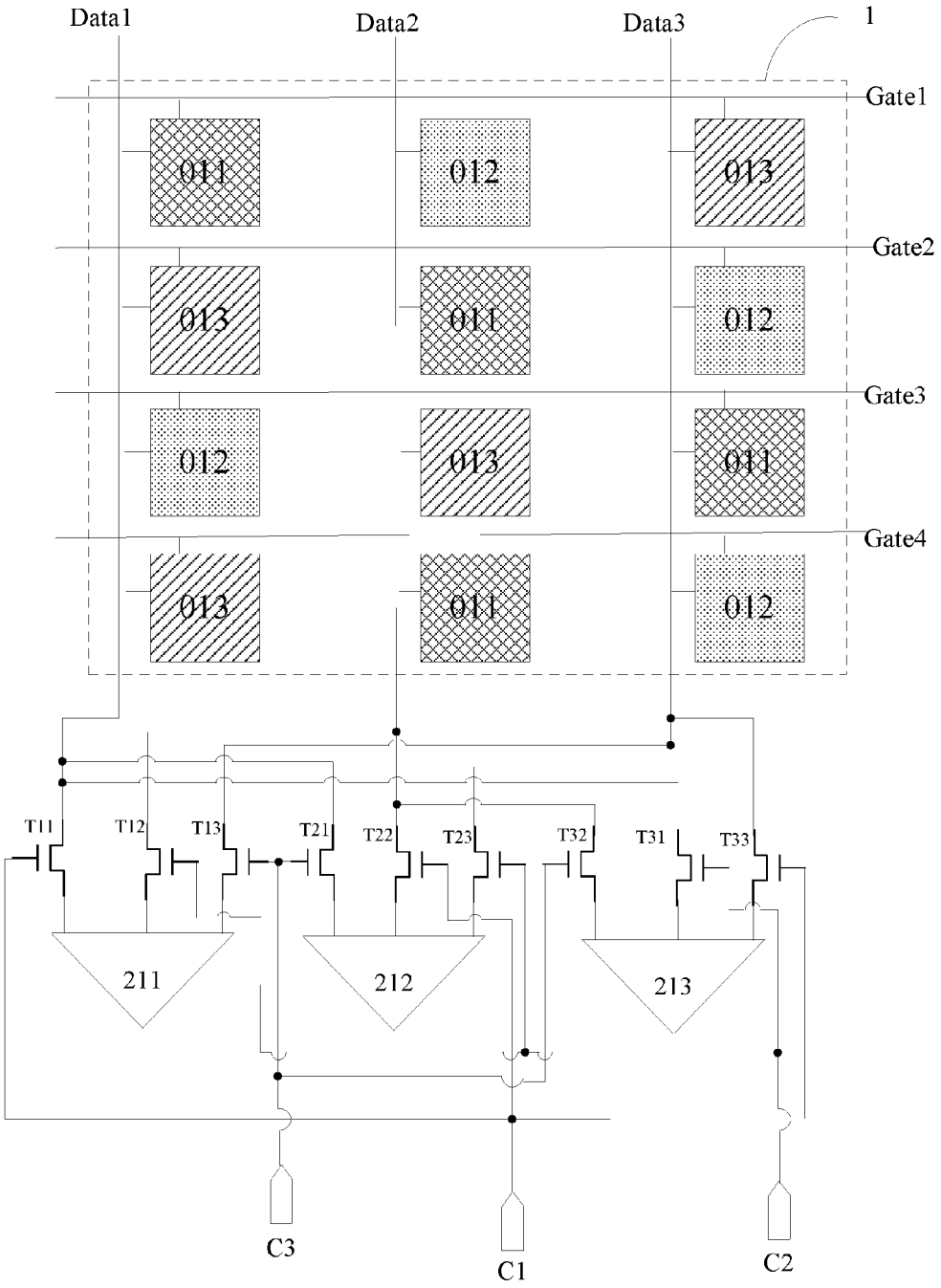
FIG. 5 is a specific structural diagram of a display panel provided by embodiments of the present disclosure.

Specifically, taking the display panels shown in FIGS. 4*b* and 4*c* as examples, when the gate line Gate 1 of the first row is scanned, the switching transistors T11, T22 and T33 are in conducting state simultaneously, the switching transistors T13, T21 and T32 are in cut-off state simultaneously, and the switching transistors T12, T23 and T31 are in cut-off state simultaneously. When the gate line Gate 2 of the second row is scanned, the switching transistors T13, T21 and T32 are in conducting state simultaneously, the switching transistors T11, T22 and T33 are in cut-off state simultaneously, and the switching transistors T12, T23 and T31 are in cut-off state simultaneously. When the gate line Gate 3 of the third row is scanned, the switching transistors T12, T23 and T31 are in conducting state simultaneously, the switching transistors T13, T21 and T32 are in cut-off state simultaneously, and the switching transistors T11, T22 and T33 are in cut-off state simultaneously. When the gate line Gate 4 of the fourth row is scanned, the switching transistors T11, T22 and T33 are in conducting state simultaneously, the switching transistors T13, T21 and T32 are in cut-off state simultaneously, and the switching transistors T12, T23 and T31 are in cut-off state simultaneously. Accordingly, the switching transistors T11, T22 and T33 are always in conducting state or cut-off state simultaneously, the switching transistors T12, T23 and T31 are always in conducting state or cut-off state simultaneously, and the switching transistors T13, T21 and T32 are always in conducting state or cut-off state simultaneously. Therefore, as shown in FIG. 5, the control unit (not shown in FIG. 5) can send the same control signal C1 to the switching transistors T11, T22 and T33, send the same control signal C2 to the switching transistors T12, T23 and T31, and send the same control signal C3 to the switching transistors T13, T21 and T32.

Figure 6:
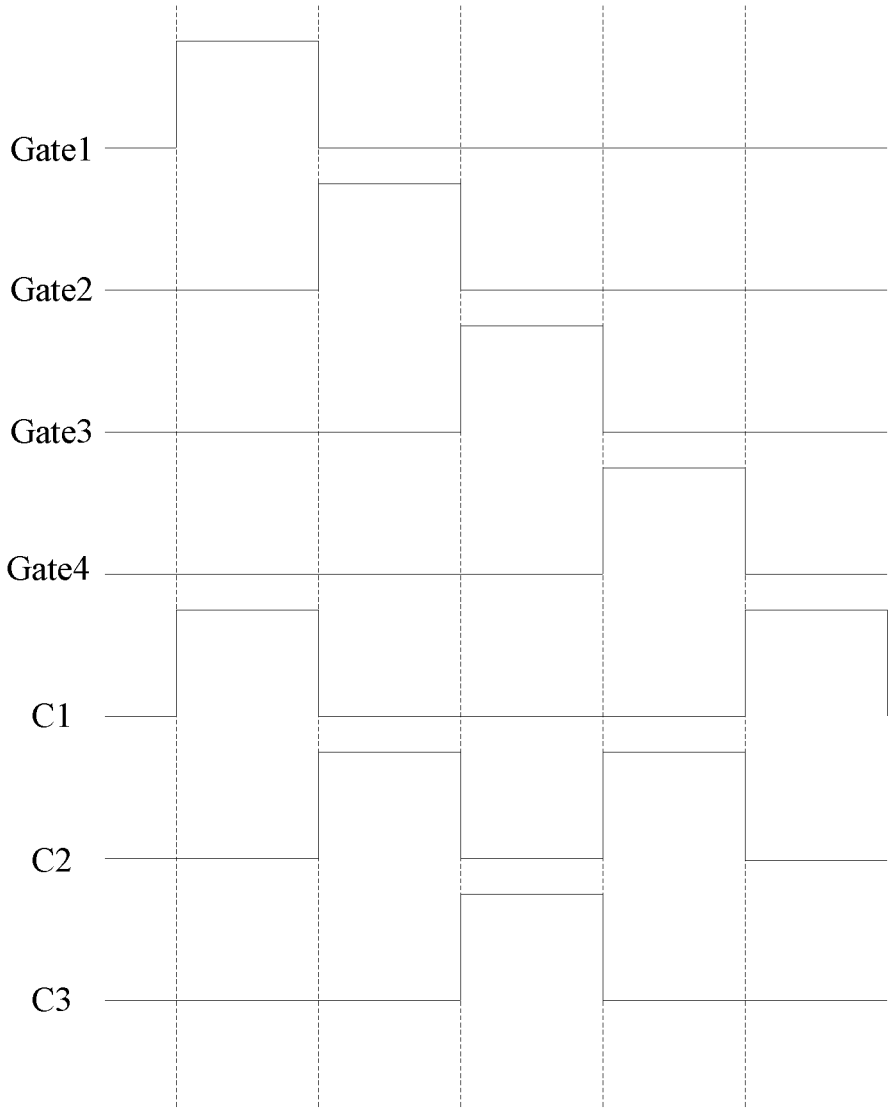
FIG. 6 is a circuit timing diagram of the display panel shown in FIG. 5.

Taking the display panel shown in FIG. 5 as an example, the working process thereof is described below in detail, and the working timing diagram is as shown in FIG. 6. In the following description 1 represents a high level signal, while 0 represents a low level signal.

When the gate line Gate 1 of the first row is scanned, C1=1, C2=0, C3=0. The switching transistors T11, T22 and T33 are in conducting state, and the remaining switching transistors are in cut-off state. The operational amplifier 211 provides a data signal to the subpixel 011 of the first color in the first row via the switching transistor T11, the operational amplifier 212 provides a data signal to the subpixel 012 of the second color in the first row via the switching transistor T22, and the operational amplifier 213 provides a data signal to the subpixel 013 of the third color in the first row via the switching transistor T33.

When the gate line Gate 2 of the second row is scanned, C1=0, C2=1, C3=0. The switching transistors T12, T23 and T31 are in conducting state, and the remaining switching transistors are in cut-off state. The operational amplifier 211 provides a data signal to the subpixel 011 of the first color in the second row via the switching transistor T12, the operational amplifier 212 provides a data signal to the subpixel 012 of the second color in the second row via the switching transistor T23, and the operational amplifier 213 provides a data signal to the subpixel 013 of the third color in the second row via the switching transistor T31.

When the gate line Gate 3 of the third row is scanned, C1=0, C2=0, C3=1. The switching transistors T13, T21 and T32 are in conducting state, and the remaining switching transistors are in cut-off state. The operational amplifier 211 provides a data signal to the subpixel 011 of the first color in the third row via the switching transistor T13, the operational amplifier 212 provides a data signal to the subpixel 012 of the second color in the third row via the switching transistor T21, and the operational amplifier 213 provides a data signal to the subpixel 013 of the third color in the third row via the switching transistor T32.

When the gate line Gate 4 of the fourth row is scanned, C1=0, C2=1, C3=0. The switching transistors T12, T23 and T31 are in conducting state, and the remaining switching transistors are in cut-off state. The operational amplifier 211 provides a data signal to the subpixel 011 of the first color in the fourth row via the switching transistor T12, the operational amplifier 212 provides a data signal to the subpixel 012 of the second color in the fourth row via the switching transistor T23, and the operational amplifier 213 provides a data signal to the subpixel 013 of the third color in the fourth row via the switching transistor T31.

Thereafter, the above four processes are cycled by the first control signal C1, the second control signal C2 and the third control signal C3 until all the gate lines are scanned.

On the basis of the same concept, embodiments of the present disclosure further provide a method for driving any display panel stated above, comprising:

scanning the gate lines of respective rows successively within one frame of picture;

for the subpixels of the m-th column of the display panel, when the gate line of the n-th row is scanned, the control unit controlling one of the switching devices connected to the data line connected to the subpixels of the m-th column to be in conducting state, the operational amplifiers corresponding to the subpixels of the n-th row outputting data signals to the subpixels of the n-th row via the switching device in conducting state.

On the basis of the same concept, embodiments of the present disclosure further provide a display apparatus comprising any of the above display panels provided by embodiments of the present disclosure. The display apparatus may be any product or component having display function such as mobile phone, tablet computer, television, display, notebook computer, digital frame, navigator, and so on. Implementation of the display apparatus may refer to the embodiments of the above display panel. Repeated parts are not described here for simplicity.

In the display panel, driving method and display apparatus provided by embodiments of the present disclosure, since the data signals are outputted by different operational amplifiers to the subpixels of different colors connected to the same data line, and the data signals are outputted by the same operational amplifier to the subpixels of the same color connected with the same data line, when the above display panel displays one frame of picture of solid color, even if the subpixels of different colors correspond to different grayscale values, since the subpixels of the same color connected to the same data line correspond to the same operational amplifier, that is, the data signals of the subpixels of the same color which have the same grayscale value are always outputted by the same operational amplifier, grayscale jump would not take place. Consequently, the charging amounts for the subpixels of the same color are identical and the brightnesses thereof are also the same upon display, thereby eliminating the bright and dark horizontal stripes presented on the display panel when displaying a picture of solid color and improving the display effect of the display panel.

Obviously, those skilled in the art can make various modifications and variations to the present disclosure without departing from the spirit and scope thereof. In this way, if these modifications and variations to the present disclosure pertain to the scope of the claims of the present disclosure and equivalent technologies thereof, the present disclosure also intends to encompass these modifications and variations.

The invention claimed is:

1. A display panel comprising: several pixel groups arranged in a matrix which consist of N-row×M-column subpixels, gate lines connected to subpixels of respective rows, and data lines connected to subpixels of respective columns; wherein N is a positive integer larger than 2, M is a positive integer larger than 1, and in one and the same pixel group, subpixels of the same column comprise subpixels of at least two colors, the display panel further comprising:

a plurality of operational amplifiers corresponding to respective data lines, respective operational amplifiers being connected to corresponding data lines via corresponding switching devices, respectively, and a control unit connected to respective switching devices, wherein, the number of operational amplifiers corresponding to each data line is equal to that of color types of subpixels connected to the data line, and one operational amplifier corresponds to subpixels of one color, in a plurality of operational amplifiers corresponding to each data line, respective operational amplifiers are used to output data signals to subpixels of corresponding colors connected to the corresponding data line successively according to a scanning order of the gate lines;

the control unit is used to, for subpixels of the m-th column of the display panel, control one of the switching devices connected to the data line that is connected to the subpixels of the m-th column to be in conducting state when the gate line of the n-th row is scanned, and the switching device in conducting state is a switching device connected to the operational amplifier for outputting data signals to the subpixels of the n-th row.

2. The display panel according to claim 1, wherein, when M is larger than 1, for M data lines corresponding to each column of pixel groups, the data lines connected with subpixels of the same color correspond to the same operational amplifier that outputs data signals to the subpixels of the same color.

3. The display panel according to claim 2, wherein in one and the same pixel group, the number of color types of the subpixels in each column of subpixels is the same, and the color types are the same.

4. The display panel according to claim 3, wherein N=4, M=3, and in one and the same pixel group, subpixels of a first row are a subpixel of a first color, a subpixel of a second color and a subpixel of a third color, respectively, subpixels of a second row are a subpixel of the third color, a subpixel of the first color and a subpixel of the second color, respectively, subpixels of a third row are a subpixel of the second color, a subpixel of the third color and a subpixel of the first color, respectively, subpixels of a fourth row are a subpixel of the third color, a subpixel of the first color and a subpixel of the second color, respectively.

5. The display panel according to claim 4, wherein the first color, the second color and the third color are one of red, green and blue, respectively.

6. The display panel according to claim 2, wherein the switching device is a transmission gate, and a positive phase control terminal and a negative phase control terminal of the transmission gate are both connected to the control unit, an input terminal of the transmission gate is connected to corresponding operational amplifiers, and an output terminal of the transmission gate is connected to corresponding data lines.

7. The display panel according to claim 3, wherein the switching device is a transmission gate, and a positive phase control terminal and a negative phase control terminal of the transmission gate are both connected to the control unit, an input terminal of the transmission gate is connected to corresponding operational amplifiers, and an output terminal of the transmission gate is connected to corresponding data lines.

8. The display panel according to claim 4, wherein the switching device is a transmission gate, and a positive phase control terminal and a negative phase control terminal of the transmission gate are both connected to the control unit, an input terminal of the transmission gate is connected to corresponding operational amplifiers, and an output terminal of the transmission gate is connected to corresponding data lines.

9. The display panel according to claim 1, wherein the switching device is a transmission gate, and a positive phase control terminal and a negative phase control terminal of the transmission gate are both connected to the control unit, an input terminal of the transmission gate is connected to corresponding operational amplifiers, and an output terminal of the transmission gate is connected to corresponding data lines.

10. The display panel according to claim 1, wherein the switching device is a switching transistor, and a gate of the switching transistor is connected to the control unit, a first end of the switching transistor is connected to corresponding operational amplifiers, a second end of the switching transistor is connected to corresponding data lines, the first end and the second end are one of a source and a drain, respectively.

11. The display panel according to claim 10, wherein the switching transistor is an N-type transistor or P-type transistor.

12. A method for driving the display panel according to claim 1, comprising:

scanning gate lines of respective rows successively within one frame of picture;

for subpixels of the m-th column of the display panel, when the gate line of the n-th row is scanned, the control unit controlling one of the switching devices connected to the data line that is connected to the subpixels of the m-th column to be in conducting state, the operational amplifiers corresponding to the subpixels of the n-th row outputting data signals to the subpixels of the n-th row via the switching device in conducting state.

13. A display apparatus comprising a display substrate, the display panel comprising: several pixel groups arranged in a matrix which consist of N-row×M-column subpixels, gate lines connected to subpixels of respective rows, and data lines connected to subpixels of respective columns; wherein N is a positive integer larger than 2, M is a positive integer larger than 1, and in one and the same pixel group, subpixels of the same column comprise subpixels of at least two colors, the display panel further comprising:

a plurality of operational amplifiers corresponding to respective data lines, respective operational amplifiers being connected to corresponding data lines via corresponding switching devices, respectively, and a control unit connected to respective switching devices, wherein, the number of operational amplifiers corresponding to each data line is equal to that of color types of subpixels connected to the data line, and one operational amplifier corresponds to subpixels of one color, in a plurality of operational amplifiers corresponding to each data line, respective operational amplifiers are used to output data signals to subpixels of corresponding colors connected to the corresponding data line successively according to a scanning order of the gate lines;

the control unit is used to, for subpixels of the m-th column of the display panel, control one of the switching devices connected to the data line that is connected to the subpixels of the m-th column to be in conducting state when the gate line of the n-th row is scanned, and the switching device in conducting state is a switching device connected to the operational amplifier for outputting data signals to the subpixels of the n-th row.

14. The display apparatus according to claim 13, wherein, when M is larger than 1, for M data lines corresponding to each column of pixel groups, the data lines connected with subpixels of the same color correspond to the same operational amplifier that outputs data signals to the subpixels of the same color.

15. The display apparatus according to claim 14, wherein in one and the same pixel group, the number of color types of the subpixels in each column of subpixels is the same, and the color types are the same.

16. The display apparatus according to claim 15, wherein N=4, M=3, and in one and the same pixel group, subpixels of a first row are a subpixel of a first color, a subpixel of a second color and a subpixel of a third color, respectively, subpixels of a second row are a subpixel of the third color, a subpixel of the first color and a subpixel of the second color, respectively, subpixels of a third row are a subpixel of the second color, a subpixel of the third color and a subpixel of the first color, respectively, subpixels of a fourth row are a subpixel of the third color, a subpixel of the first color and a subpixel of the second color, respectively.

17. The display apparatus according to claim 16, wherein the first color, the second color and the third color are one of red, green and blue, respectively.

18. The display apparatus according to claim 13, wherein the switching device is a transmission gate, and a positive phase control terminal and a negative phase control terminal of the transmission gate are both connected to the control unit, an input terminal of the transmission gate is connected to corresponding operational amplifiers, and an output terminal of the transmission gate is connected to corresponding data lines.

19. The display apparatus according to claim 13, wherein the switching device is a switching transistor, and a gate of the switching transistor is connected to the control unit, a first end of the switching transistor is connected to corresponding operational amplifiers, a second end of the switching transistor is connected to corresponding data lines, the first end and the second end are one of a source and a drain, respectively.

20. The display apparatus according to claim 14, wherein the switching transistor is an N-type transistor or P-type transistor.

* * * * *